US005261598A

United States Patent [19]

Shirayanagi et al.

[11] Patent Number: 5,261,598

[45] Date of Patent: Nov. 16, 1993

[54] SAFETY DEVICE FOR A COMBUSTION APPARATUS

[75] Inventors: Susumu Shirayanagi, Toyoake; Yasuyuki Suzuki, Yokkaichi; Tomohisa Ishiguro, Nagoya, all of Japan

[73] Assignee: Paloma Kogyo Kabushiki Kaisha, Nagoya, Japan

[21] Appl. No.: 759,490

[22] Filed: Sep. 13, 1991

[51] Int. Cl.[5] ..... F23N 5/24

[52] U.S. Cl. ..... 236/21 B; 436/21; 337/416

[58] Field of Search ..... 431/21, 23; 337/159, 337/295, 416, 417; 122/504.1, 504.3; 236/21 B

[56] References Cited

U.S. PATENT DOCUMENTS 1,957,565 5/1934 Wheeler ..... 337/416
4,089,632 5/1978 Rexroad ..... 431/21

FOREIGN PATENT DOCUMENTS 48-37858 5/1973 Japan .
49-8839 1/1974 Japan .

*Primary Examiner*—John M. Sollecito
*Attorney, Agent, or Firm*—Lahive & Cockfield

[57] ABSTRACT

A safety device for a combustion apparatus comprises a continuous, linear temperature-sensing element formed of a material which is electrically conductive and melts, or breaks, at a relatively low temperature and located along at least one side of a combustion chamber of a combustion apparatus and one side of a heat exchanger thereof. The temperature-sensing element is electrically connected to a combustion control circuit such that, if and when the combustion chamber or the heat exchanger has reached an extremely high temperature, the temperature-sensing element melts, or breaks to cause said combustion control circuit to stop a combustion in said combustion chamber. Lead, tin, or an alloy of lead and tin may be employed as the material of the temperature-sensing element.

7 Claims, 8 Drawing Sheets

SAFETY DEVICE FOR A COMBUSTION APPARATUS

FIELD OF THE INVENTION

This invention relates to a safety device for stopping combustion in a combustion apparatus if and when the combustion apparatus has reached an excessively high temperature.

BACKGROUND OF THE INVENTION

FIG. 1 depicts prior art. A hot-water supply apparatus shown in FIG. 1 is provided with a thermal fuse 3' enclosed in a glass tube or in a ceramic tube and connected to the inside of the rear of the shell. As illustrated, the thermal fuse 3' is located in close proximity to a heat exchanger 2' and to a combustion chamber 1' so that the thermal fuse 3' melts when the heat exchanger 2' or the combustion chamber 1' has reached an excessively high temperature. The thermal fuse 3' is electrically connected to a combustion control circuit (not shown). Although not shown, there is also prior art where plural thermal fuses are provided in scattered positions which are in close proximity to the combustion chamber and to the heat exchanger.

A combustion apparatus, especially a hot-water supply apparatus, is often used continuously for a long time. Continuous use of a combustion apparatus may cause its combustion chamber or heat exchanger to reach such a high temperature as to be cracked or perforated. If it is cracked or perforated, the combustion gas may leak through the crack or perforation and cause a fire. Thus, if the combustion chamber or the heat exchanger has reached such a dangerous temperature, it is necessary to detect it instantly and stop the combustion without delay.

In the prior art of FIG. 1, however, if a portion of the combustion chamber 1' or the heat exchanger 2' which is at a distance from the thermal fuse 3' has reached such a dangerous temperature, the thermal fuse 3' does not detect the dangerous temperature, or does not melt. In such a case, therefore, the thermal fuse 3' cannot prevent a fire. Plural thermal fuses provided in scattered positions around the combustion chamber and the heat exchanger are more successful in detecting a dangerous temperature than the single thermal fuse 3'. However, even plural thermal fuses in scattered positions do not always succeed in detecting a dangerous temperature since "blind spots" may exist. Also, it takes much time and trouble to provide plural thermal fuses in scattered positions. It is also expensive to provide plural thermal fuses.

SUMMARY OF THE INVENTION

It is an object of the invention to provide a safety device for a combustion apparatus which is capable of detecting an excessively high temperature of the combustion apparatus whichever portion in an intended area of the apparatus is subjected to such a temperature and stopping the combustion in the combustion apparatus at the same time that the safety device detects the excessively high temperature.

DETAILED DESCRIPTION OF PREFERRED EMBODIMENTS

Different embodiments of the invention will now be described with reference to FIGS. 2 to 8.

Figure 2:
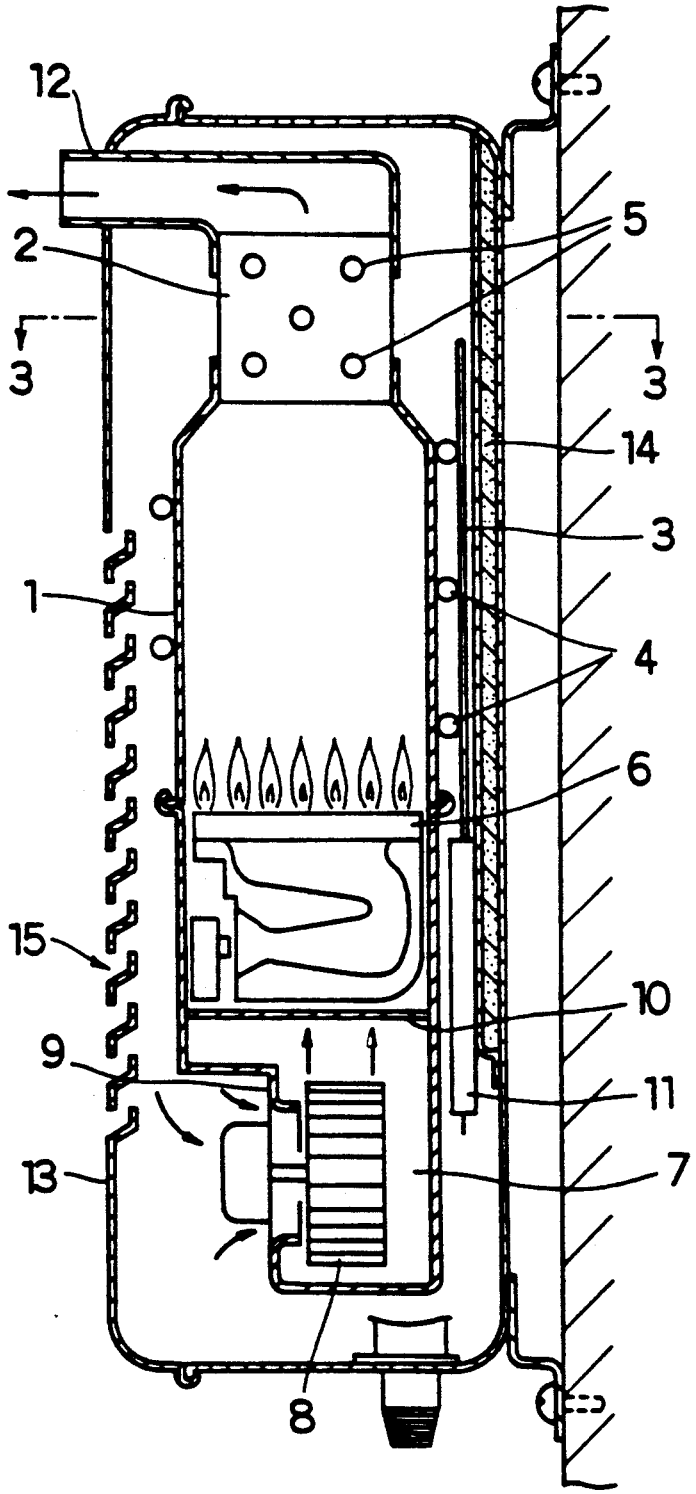
FIG. 2 is a vertical cross section of a hot-water supply apparatus with a first embodiment of the invention.
Figure 3:
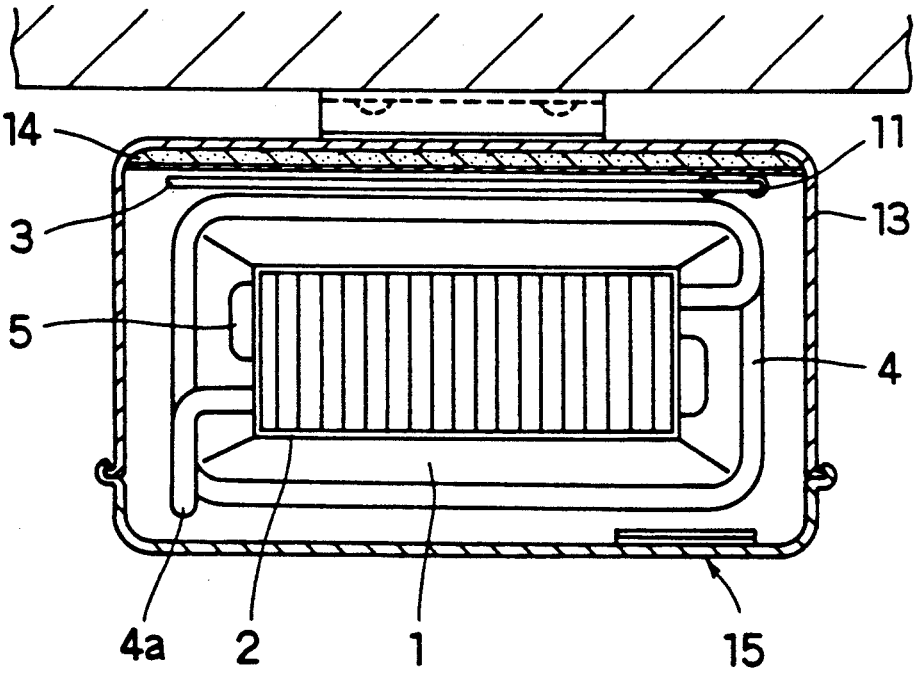
FIG. 3 is a horizontal cross section taken on line X—X of FIG. 2.

FIGS. 2 and 3 show a first embodiment of the invention. FIG. 2 is a vertical cross section of a hot-water supply apparatus which uses a fan to supply air and employs gas to heat water, while FIG. 3 is a horizontal cross section taken on line X—X of FIG. 2. In FIG. 2 the hot-water supply apparatus is fixed to a wall.

Figure 1:
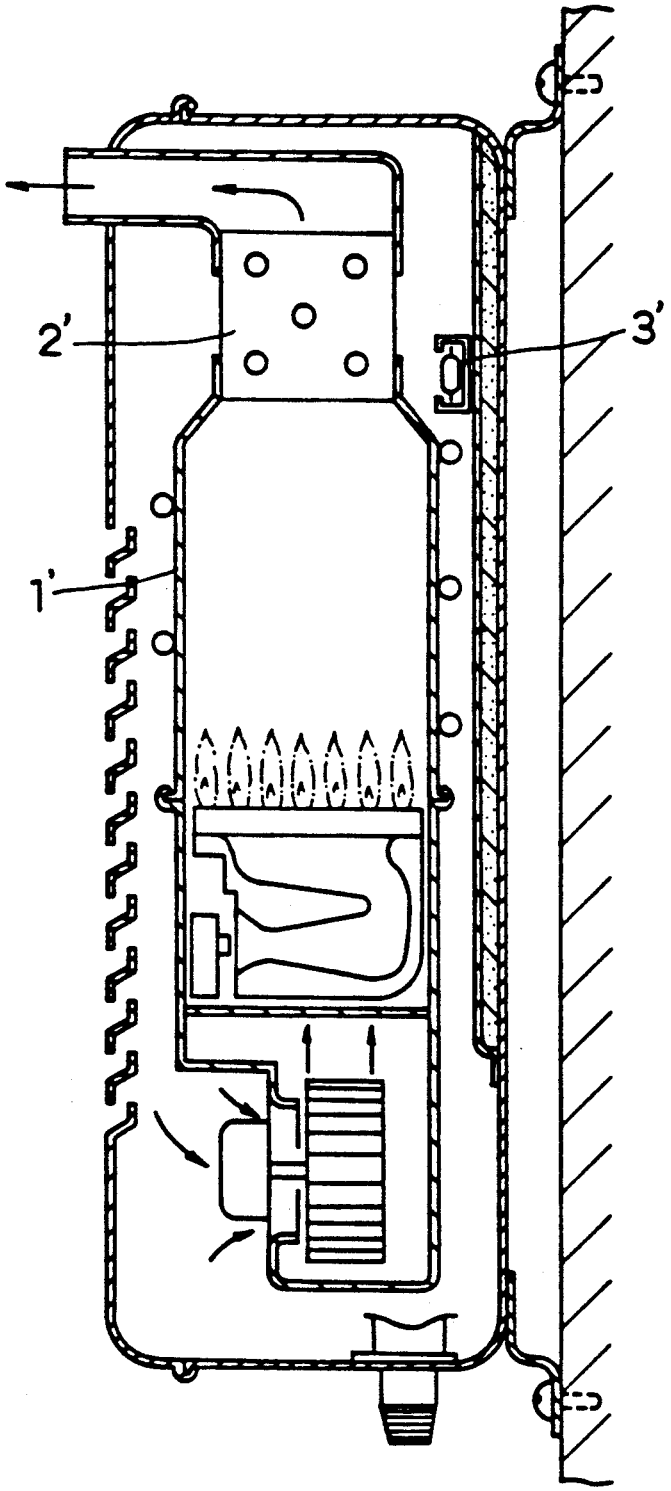
FIG. 1 (PRIOR ART)
FIG. 1 shows prior art.

The hot-water supply apparatus of FIGS. 1 and 2 includes a combustion chamber 1. A water-supply pipe 4 is wound round the combustion chamber 1. Although it is difficult to have an idea of what the overall shape of the water-supply pipe 4 is from FIGS. 2 and 3, the water-supply pipe 4 is wound round the combustion chamber in a helical shape. A heat exchanger 2 is located on the combustion chamber 1. The heat exchanger 2 has a heat-absorbing conduit 5. The upper end of the water-supply pipe 4 is connected to an inlet of the heat-absorbing conduit 5. An outlet of the heat-absorbing conduit 5 is connected to a hot-water supply pipe 4*a*. A gas burner 6 is located in a lower portion of the combustion chamber 1. An air supply chamber 7 is located beneath the gas burner 6. The air supply chamber 7 is separated from the gas burner 6 by a horizontal partition plate 10. However, the partition plate 10 is provided with openings and, thus, the air supply chamber 7 communicates with the gas burner 6 through these openings. A fan 8 is located in the air-supply chamber 7. When the fan 8 is operated, a current of air is created. The air passes from the air-supply chamber 7 through the openings of the partition plate 10 into the gas burner 6. The air is used for combustion by the gas burner 6. The gas burner 6 heats the heat exchanger 2. Water supplied into the heat-absorbing conduit 5 from the water-supply pipe 4 is thus heated. The hot water comes out from the hot-water supply pipe 4*a* into a kitchen sink or a bath.

A temperature sensing element 3 is located at the back of the combustion chamber 1 and the heat exchanger 2. The rear portion of the water-supply pipe 4 is located between the combustion chamber 1 and the temperature sensing element 3. The temperature sensing element 3 is made of a material which is electrically conductive and melts at a relatively low temperature, such as lead, tin, or an alloy of lead and tin. Also, the temperature sensing element has a continuous, linear shape. For example, the temperature sensing element 3 may be formed such that it has a shape of FIG. 4 covering a substantial two dimensional area viewed from the right side of FIG. 2. The temperature sensing element 3 is connected, at both its ends, to a combustion control circuit (not shown) by means of leads 11.

In use, if the rear of the combustion chamber 1 or of the heat exchanger 2 reaches such a high temperature as to be cracked or perforated, the portion of the temperature sensing element 3 nearest to the hottest portion of the rear of the combustion chamber 1 or of the heat exchanger 2, or nearest to the portion thereof which has been cracked or perforated, melts. When the temperature sensing element 3 thus melts, or breaks, the combustion control circuit is de-energized. Thus, a fuel control valve is closed to stop the fuel from being supplied to the gas burner.

With regard to melting point, the temperature sensing element 3 can be formed such that it melts at a temperature of from 120° to 200° C.

Figure 4:
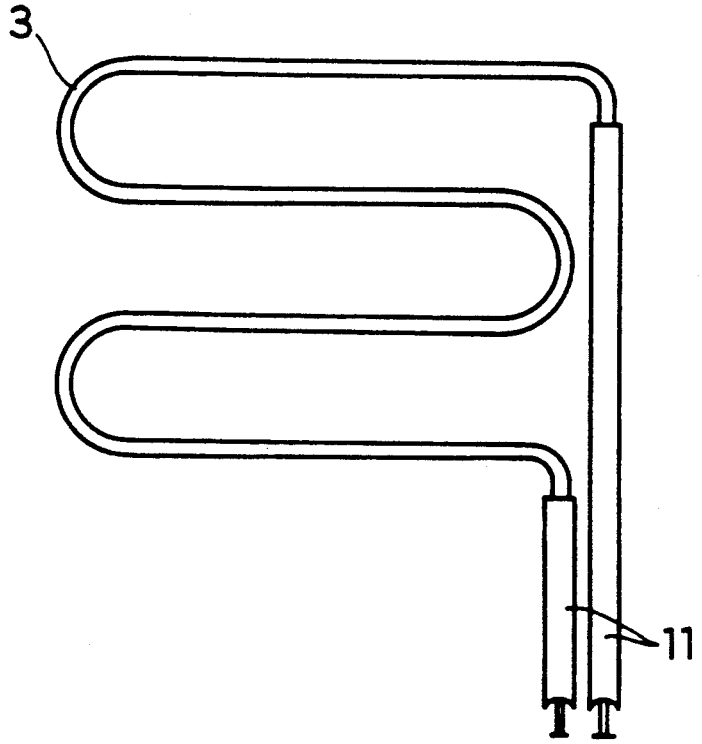
FIG. 4 shows a temperature sensing element.

The shape of FIG. 4 is one possible example of the shape of temperature sensing element 3. Temperature sensing element can be formed in any other shape whereby it melts when any portion of the rear of the combustion chamber 1 or of the heat exchanger 2 has reached an excessively high temperature, or such a high temperature as to be cracked or perforated.

In FIGS. 2 and 3 reference numeral 12 designates an air exhaust pipe; reference numeral 13, a shell; reference numeral 14, a heat insulating material; and reference numeral 15, air intake ports.

Figure 5:
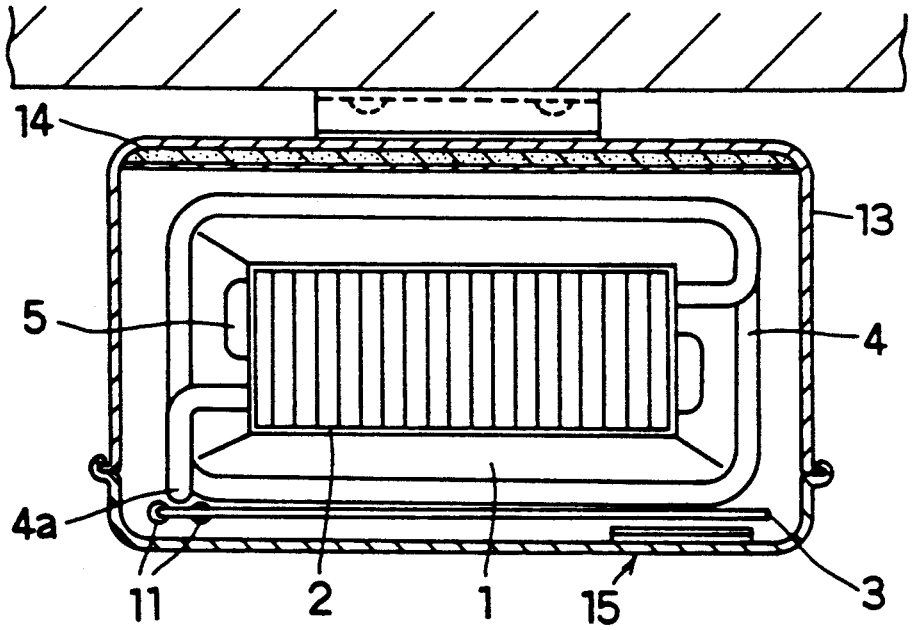
FIG. 5 is a view similar to FIG. 3 which shows a second embodiment of the invention.

FIG. 5 illustrates a second embodiment of the invention. That is, if temperature sensing element 3 is located in front of the combustion chamber 1 and the heat exchanger 2, the temperature sensing element 3 can detect an excessively high temperature of the front of the combustion chamber 1 or of the heat exchanger 2 by melting.

Figure 6:
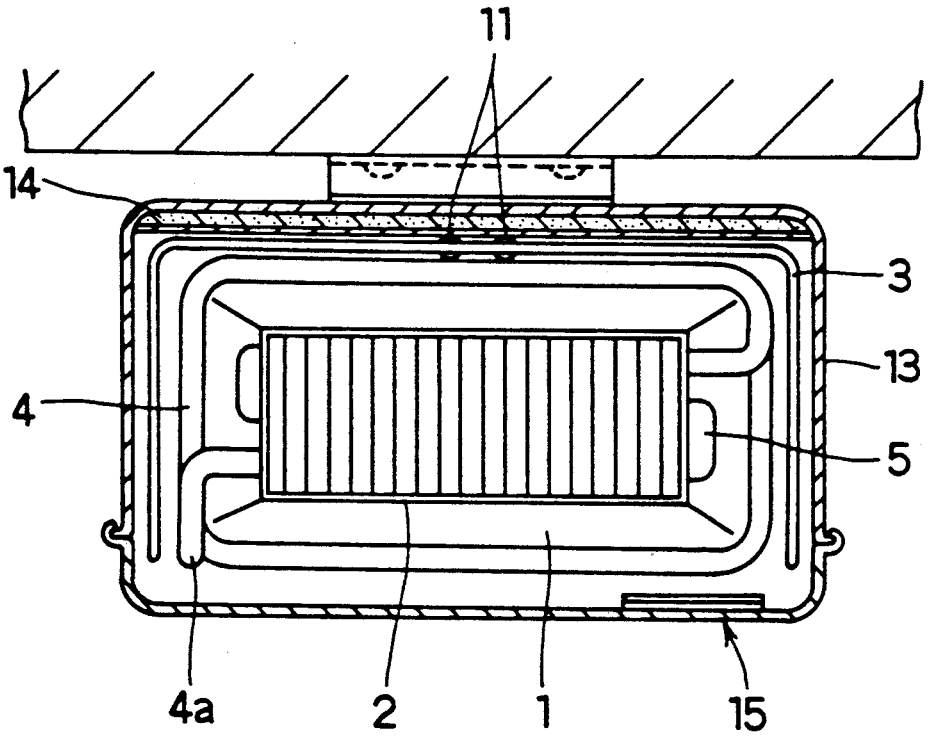
FIG. 6 is a view similar to FIG. 3 which shows a third embodiment of the invention.

FIG. 6 illustrates a third embodiment of the invention. That is, if a temperature sensing element 3 surrounding the rears and opposed sides of the combustion chamber 1 and of the heat exchanger 2 is used, such a temperature sensing element 3 can detect an excessively high temperature of the rear or opposed sides of the combustion chamber 1 or of the heat exchanger 2 by melting.

Figure 7:
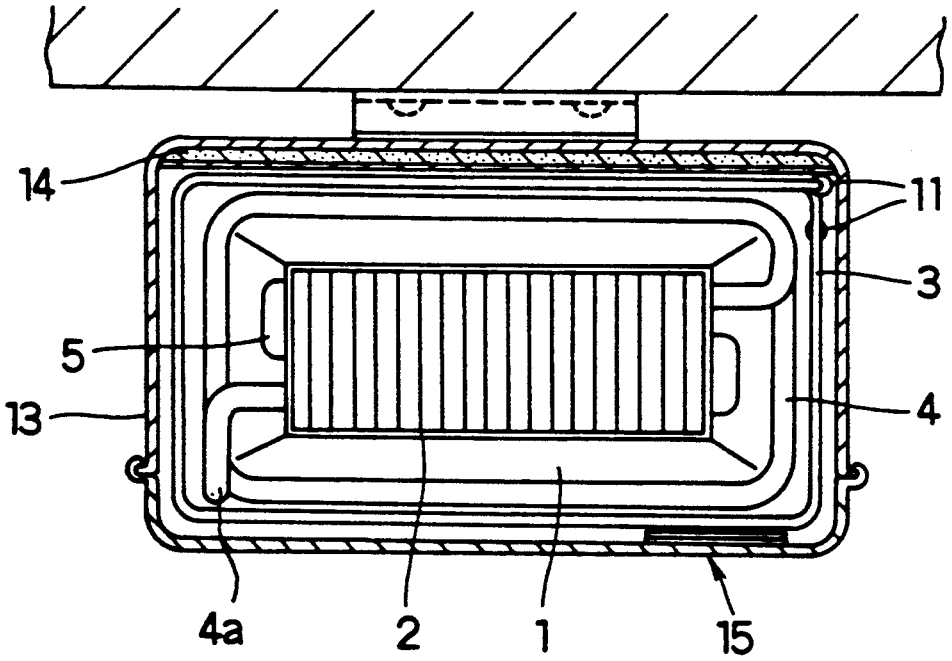
FIG. 7 is a view similar to FIG. 3 which shows a fourth embodiment of the invention.

FIG. 7 illustrates a fourth embodiment of the invention. That is, if a temperature sensing element 3 surrounding all sides of the combustion chamber 1 and of the heat exchanger 2 is used, such a temperature sensing element 3 can detect an excessively high temperature of any side of the combustion chamber 1 or of the heat exchanger 2 by melting.

Figure 8:
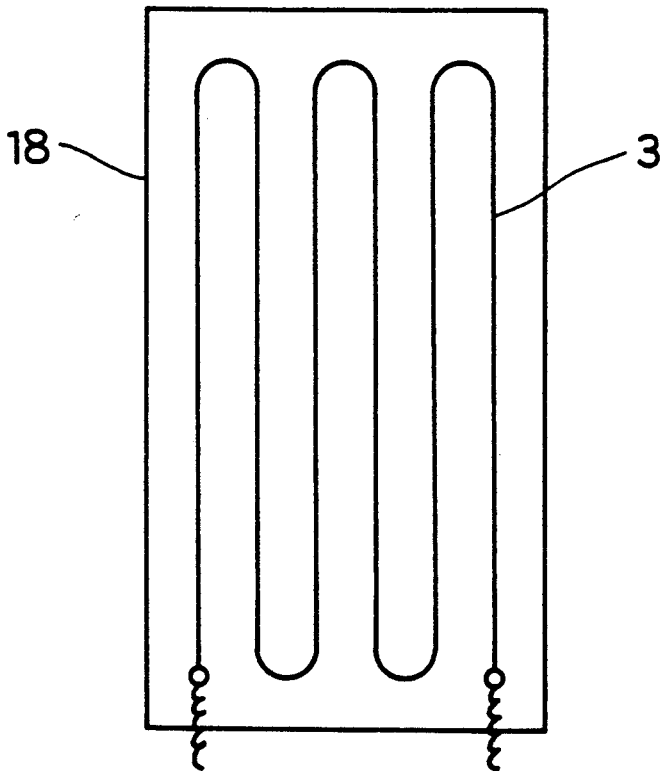
FIG. 8 shows a fifth embodiment of the invention.

FIG. 8 illustrates a fifth embodiment of the invention. That is, if desired, a temperature sensing element 3 may be printed on a sheet 18. Then, the sheet 18 can be used instead of the temperature sensing element of FIG. 2 or 5. Also, it will be appreciated that a temperature sensing element 3 may be printed on a base material having a shape similar to the shape of the temperature sensing element 3 of FIG. 6 or 7.

What is claimed is:

1. A safety device in a combustion apparatus having a combustion chamber enclosed by a wall, and a fan for blowing air under pressure into said combustion chamber, such safety device comprising a continuous, linear temperature-sensing element formed of a material which is electrically conductive and fuses at a relatively low temperature, said temperature-sensing element being located outside of said combustion chamber and extending over a substantial two dimensional area, of at least one side of the combustion chamber and one side of a heat exchanger, and said temperature-sensing element being electrically connected to a combustion control circuit such that, if and when said at least one side of said combustion chamber or of said heat exchanger has become perforated leaking pressurized combustion gases to produce an excessively high temperature, said temperature-sensing element fuses to cause said combustion control circuit to stop combustion in said combustion chamber.

2. A safety device in accordance with claim 1 wherein said temperature-sensing element is located along rears of said combustion chamber and of said heat exchanger.

3. A safety device in accordance with claim 1 wherein said temperature-sensing element is located along fronts of said combustion chamber and of said heat exchanger.

4. A safety device in accordance with claim 2 wherein said temperature-sensing element further surrounds opposed sides of said combustion chamber and of said heat exchanger.

5. A safety device in accordance with claim 2 wherein said temperature-sensing element surrounds all sides of said combustion chamber and of said heat exchange.

6. A safety device in accordance with claim 1 wherein said temperature-sensing element stretches a zigzag line.

7. A safety device in accordance with claim 1 wherein said temperature-sensing element is printed on a sheet.

* * * * *